US007083267B2

(12) United States Patent
Kawamura et al.

(10) Patent No.: US 7,083,267 B2
(45) Date of Patent: Aug. 1, 2006

(54) SLOTTED SUBSTRATES AND METHODS AND SYSTEMS FOR FORMING SAME

(75) Inventors: Naoto A. Kawamura, Corvallis, OR (US); Mark H. MacKenzie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 134 days.

(21) Appl. No.: 10/426,265

(22) Filed: Apr. 30, 2003

(65) Prior Publication Data

US 2004/0218017 A1 Nov. 4, 2004

(51) Int. Cl.
*B41J 2/05* (2006.01)

(52) U.S. Cl. ..... 347/65; 347/67

(58) Field of Classification Search ..... 347/63, 347/65, 20, 56, 61, 67, 92–94
See application file for complete search history.

(56) References Cited

U.S. PATENT DOCUMENTS 5,387,314 A * 2/1995 Baughman et al. ..... 347/65
6,247,798 B1 * 6/2001 Cleland et al. ..... 347/65
2001/0013423 A1 8/2001 Dalal et al.
2002/0003556 A1 1/2002 Mori
2002/0060720 A1 5/2002 Kim et al.
2002/0093550 A1 7/2002 Watanabe
2002/0113324 A1 8/2002 Cordes et al.
2002/0117330 A1 8/2002 Eldridge et al.
2003/0027426 A1 2/2003 Milligan et al.

FOREIGN PATENT DOCUMENTS

JP 264329 9/2002
JP 11365 1/2003

OTHER PUBLICATIONS

EP Search Report dated Jul. 26, 2004.

* cited by examiner

*Primary Examiner*—Juanita D. Stephens

(57) ABSTRACT

Methods and systems for forming slotted substrates are described. In one exemplary embodiment, a substrate has a thickness defined by a first surface and a generally opposing second surface. The substrate has a fluid-feed slot extending between the first surface and the second surface with the fluid-feed slot being defined, at least in part, by a central portion and one or more capillary channels in fluid flowing relation to the central portion.

29 Claims, 6 Drawing Sheets

SLOTTED SUBSTRATES AND METHODS AND SYSTEMS FOR FORMING SAME

BACKGROUND

Inkjet printers and other printing devices have become ubiquitous in society. These printing devices can utilize a slotted substrate to deliver ink in the printing process. Such printing devices can provide many desirable characteristics at an affordable price. However, the desire for more features and lower prices continues to press manufacturers to improve efficiencies. Consumers want, among other things, high print image resolution, realistic colors, and increased pages or printing per minute. Accordingly, the present invention relates to slotted substrates suitable for use in printing devices and/or other applications.

BRIEF DESCRIPTION OF THE DRAWINGS

The same components are used throughout the drawings to reference like features and components.

DETAILED DESCRIPTION

Overview

The embodiments described below pertain to methods and systems for forming slots in a substrate. Several embodiments of this process will be described in the context of forming fluid-feed slots ("slots") in a substrate that can be incorporated into a print head die or other fluid ejecting device. Other suitable applications for exemplary slotted substrates can include various microelectromechanical (MEMs) devices, among others.

As commonly used in print head dies, the substrate can comprise a semiconductor substrate that can have microelectronics incorporated within, deposited over, and/or supported by the substrate on a thin-film surface that can be opposite a back surface or backside. The slot(s) can receive fluid such as ink from a fluid supply or reservoir. The slot can then supply the ink to fluid ejecting elements contained in ejection chambers within the print head.

In some embodiments this can be accomplished by connecting the slot to one or more ink feed passageways, each of which can supply an individual ejection chamber. The fluid ejecting elements commonly comprise piezo-electric crystals or heating elements such as firing resistors that energize fluid which causes increased pressure in the ejection chamber. A portion of that fluid can be ejected through a firing nozzle with the ejected fluid being replaced by fluid from the slot. Bubbles can, among other origins, be formed in the ink as a byproduct of the ejection process. If the bubbles accumulate in the slot they can occlude ink flow to some or all of the ejection chambers and cause the print head to malfunction.

In some embodiments, the slots can extend between a first surface and a second surface and can comprise a central portion and one or more capillary channels in fluid flowing relation to the central portion. In some of these embodiments, the exemplary slots can reduce ink starvation of firing nozzles supplied by the slot.

Exemplary Printer System

Figure 1:
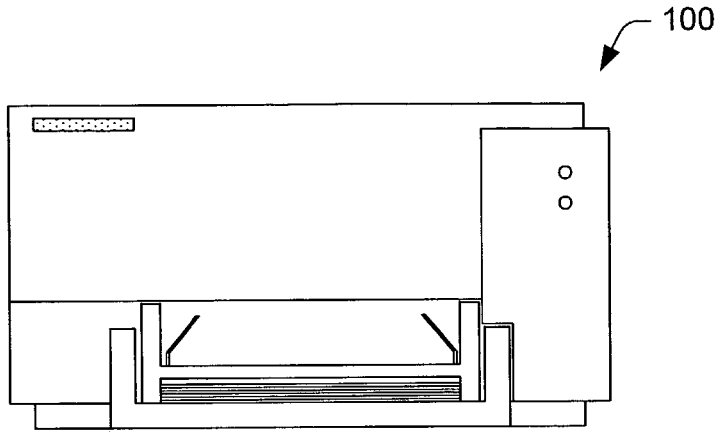
FIG. 1 shows a front elevational view of an exemplary printer in accordance with one embodiment.

FIG. 1 shows an exemplary printing device that can utilize an exemplary slotted substrate. In this embodiment, the printing device comprises a printer 100. The printer shown here is embodied in the form of an inkjet printer. The printer 100 can be capable of printing in black-and-white and/or in black-and-white as well as color. The term "printing device" refers to any type of printing device and/or image forming device that employs slotted substrate(s) to achieve at least a portion of its functionality. Examples of such printing devices can include, but are not limited to, printers, facsimile machines, photocopiers, and other fluid ejecting devices.

Figure 2:
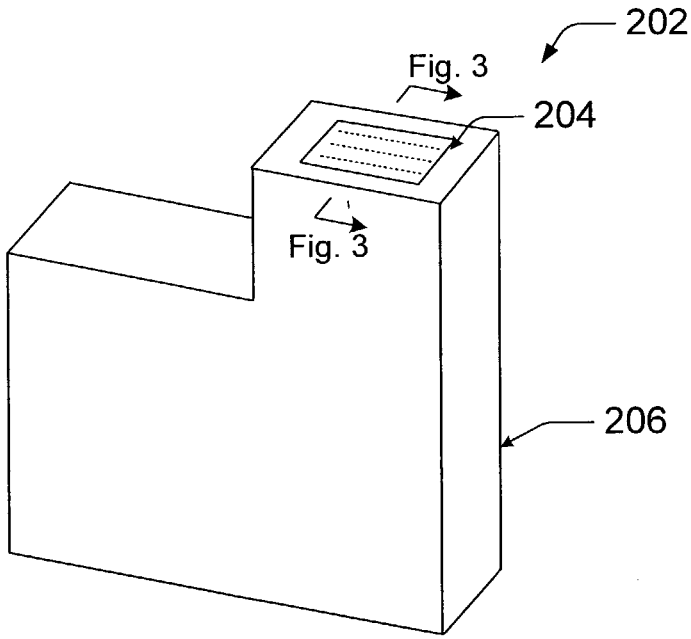
FIG. 2 shows a perspective view of an exemplary print cartridge in accordance with one embodiment.

FIG. 2 shows an exemplary print cartridge or pen 202 that can be used in an exemplary printing device such as printer 100. The print cartridge 202 is comprised of print head 204 and cartridge body 206. While a single print head is shown on print cartridge 202, other print cartridges may have multiple print heads on a single print cartridge. Some suitable print cartridges can be disposable, while others can have a useful lifespan equal to or exceeding that of the printing device. Other exemplary configurations will be recognized by those of skill in the art.

Figure 3:
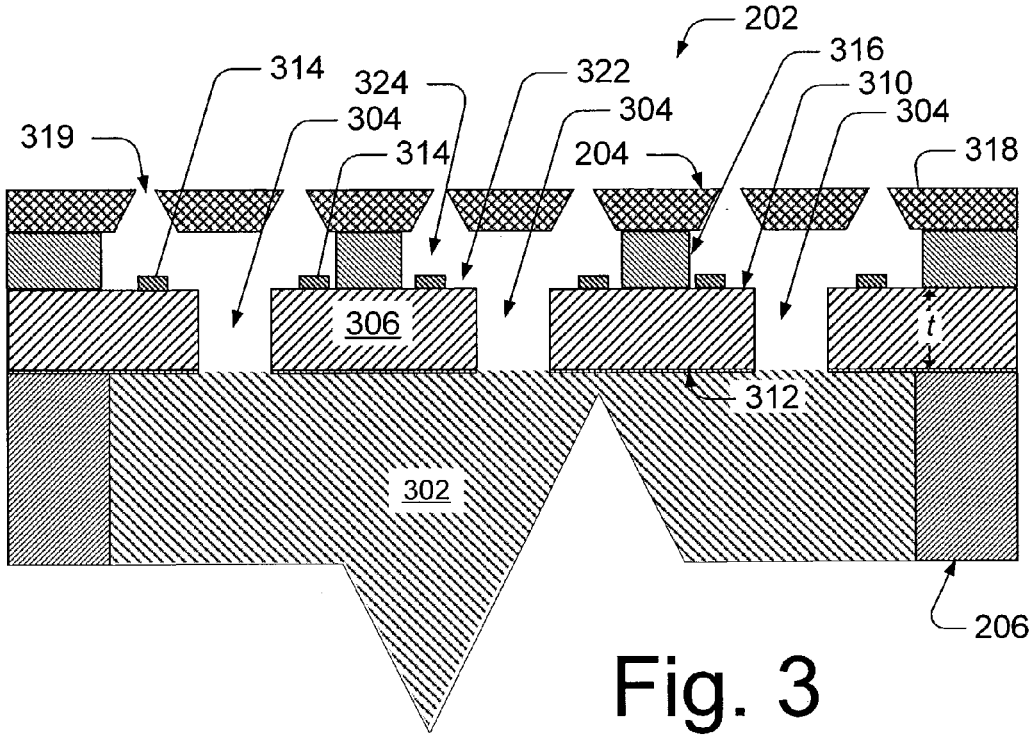
FIG. 3 shows a cross-sectional view of a top portion of an exemplary print cartridge in accordance with one embodiment.

FIG. 3 shows a cross-sectional representation of a portion of the exemplary print cartridge 202 as shown in FIG. 2. FIG. 3 shows the cartridge body 206 containing fluid 302 for supply to print head 204. In this embodiment, the print cartridge is configured to supply one color of fluid or ink to the print head. In this embodiment, a number of different slots 304 supply ink 302 for ejecting from print head 202.

Other printing devices can utilize multiple print cartridges each of which can supply a single color or black ink. In some embodiments, other exemplary print cartridges can supply multiple colors and/or black ink to a single print head. For example, other exemplary embodiments can divide the fluid supply so that each of the three slots 304 receives a separate fluid supply. Other exemplary print heads can utilize less or more slots than the three shown here.

Slots 304 pass through portions of substrate 306. In this exemplary embodiment, silicon can be a suitable substrate. In some embodiments, substrate 306 comprises a crystalline substrate such as monocrystalline silicon. Examples of other suitable substrates include, among others, gallium arsenide, glass, silica, ceramics, or a semi-conducting material. The substrate can comprise various configurations as will be recognized by one of skill in the art.

Substrate 306 has a first surface 310 separated by a thickness t from a second surface 312. The described embodiments can work satisfactorily with various thicknesses of substrate. For example, in some embodiments, the thickness t can range from less than about 100 microns to at least about 2000 microns. Other exemplary embodiments can be outside of this range. The thickness t of the substrate in one exemplary embodiment can be about 675 microns.

As shown in FIG. 3, print head 204 further comprises independently controllable fluid drop generators positioned over the substrate 306. In some embodiments, the fluid drop generators comprise firing resistors 314. In this exemplary embodiment, the firing resistors 314 are part of a stack of thin film layers positioned over the substrate's first surface 310. For this reason the first surface is often referred to as the thin-film side or thin-film surface. The thin film layers can further comprise a barrier layer 316.

The barrier layer 316 can comprise, among other things, a photo-resist polymer substrate. In some embodiments, above the barrier layer is an orifice plate 318. In one embodiment, the orifice plate comprises a nickel substrate. In another embodiment, the orifice plate is the same material as the barrier layer. The orifice plate can have a plurality of nozzles 319 through which fluid heated by the various firing resistors 314 can be ejected for printing on a print media (not shown). The various layers can be formed, deposited, or attached upon the preceding layers. The configuration given here is but one possible configuration. For example, in an alternative embodiment, the orifice plate and barrier layer are integral.

The exemplary print cartridge shown in FIGS. 2 and 3 is upside down from the common orientation during usage. When positioned for use, fluid can flow from the cartridge body 206 into one or more of the slots 304. From the slots, the fluid can travel through a fluid-feed passageway 322 that leads to an ejection or firing chamber 324 that can be defined, at least in part, by the barrier layer 316. An ejection chamber can be comprised of a firing resistor 314, a nozzle 319, and a given volume of space therein. Other configurations are also possible.

Exemplary Embodiments and Methods

Figure 4:
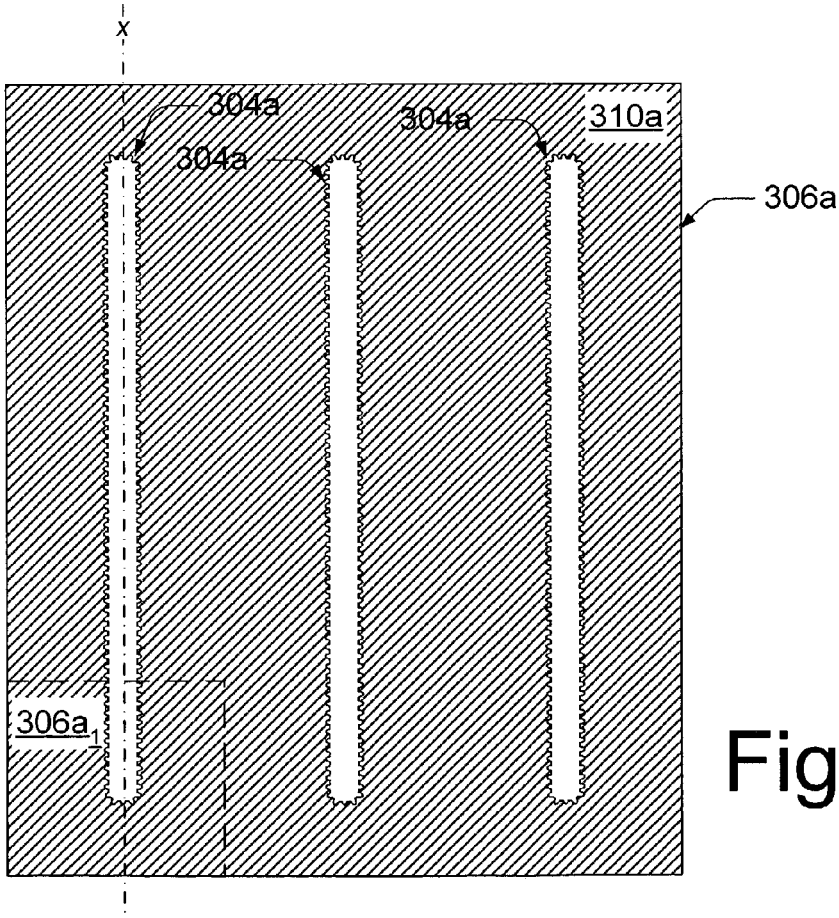
FIG. 4 shows a top view of an exemplary substrate in accordance with one embodiment.

FIG. 4 shows a view from above a first surface 310*a* of substrate 306*a*. Three fluid-feed slots 304*a* are shown. Individual fluid-feed slots extend along a long axis, an example of which is labeled "x".

Figure 5:
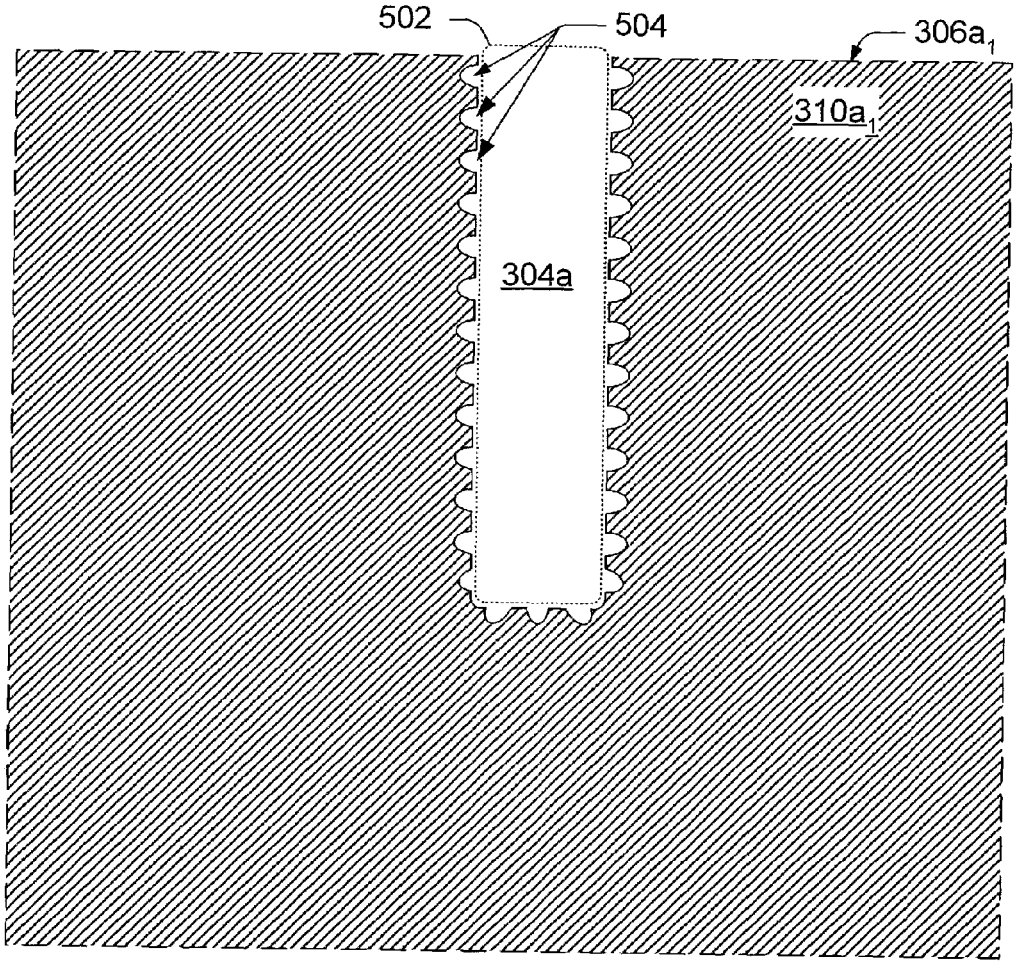
FIGS. 5–6 show top views of a portion of an exemplary substrate in accordance with one embodiment.

FIG. 5 shows a view from above first surface 310$a_1$ of substrate portion 306$a_1$. Slot 304*a*, a portion of which is shown here, comprises a central portion 502 in fluid flowing relation with one or more capillary channels 504. Such a slot configuration may, in some embodiments, increase the reliability of fluid flow through the slot.

Figure 6:
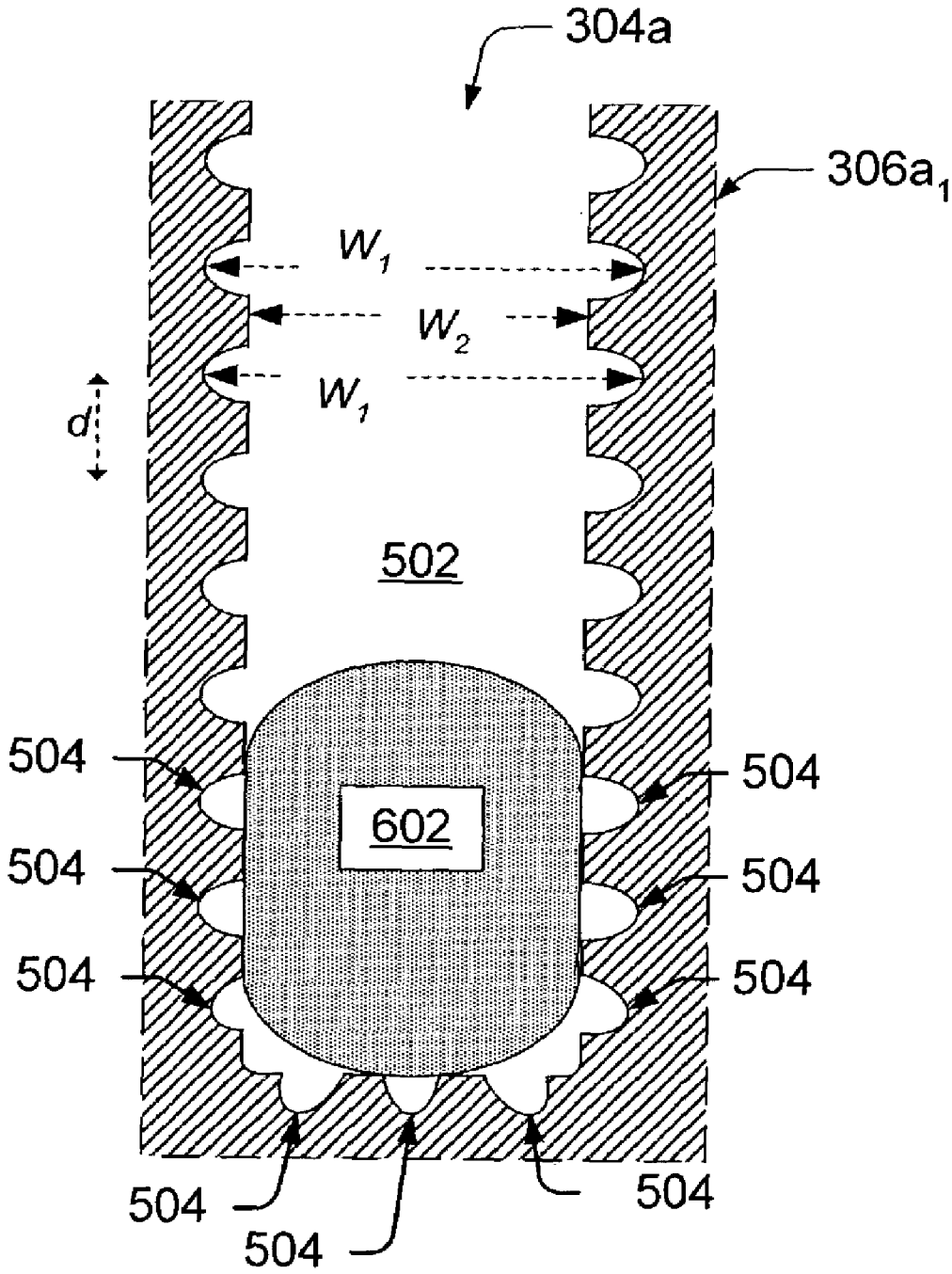

In one such example, FIG. 6 shows a further enlarged portion of slot 304*a* with gas bubble or "bubble" 602 occupying a portion of the slot. Bubbles can, among other origins, be formed in the ink as a byproduct of the ejection process when a slotted substrate supplies fluid that is ultimately ejected from an ejection chamber through a firing nozzle (described in relation to FIG. 3). If bubbles accumulate in the slot they can partially or completely occlude ink flow to some or all of the firing nozzles and cause a malfunction sometimes referred to as "ink starvation". Though a bubble is shown and discussed here, some embodiments can reduce ink starvation due to other obstructions. For example, some of the exemplary embodiments can provide ink flow to the nozzles via the capillary channels when a particle or other material blocks a portion of the central portion.

In relation to the bubble example, other slot designs can allow bubbles to block ink flow through the portion of the slot where the bubble resides. In such a design, any devices, such as ink feed passageways and associated firing nozzles, supplied by that portion of the slot are likely to receive little or no ink.

With the present embodiments, a bubble tends to remain in central portion 502 while fluid can still flow through adjacent capillary channels 504. In some embodiments, surface tension, among other factors, can contribute to the bubble's tendency to remain in central portion 502 until such a time as the bubble dissipates or migrates out of the slot. Alternatively or additionally, in some embodiments, capillary action, among other factors, can contribute to the fluid's tendency to flow through the capillary channels 504.

The embodiment represented in FIG. 6 has capillary channels 504 positioned at generally equal intervals d along central portion 502. Such need not be the case. For example, other embodiments may have capillary channels positioned at non-standard distances along the central portion, while still others may utilize capillary channels only where experimental evidence indicates fluid occlusion tends to occur. Similarly, though many embodiments can utilize capillary channels that are generally orthogonal to the first surface, other suitable embodiments can utilize other configurations.

The embodiment represented in FIG. 6 positions capillary channels in generally opposing positions creating alternating wider and narrower slot widths indicated as $w_1$ and $w_2$ respectively. Other embodiments may utilize other configurations. In one such example, individual capillary channels may be positioned to line up with individual ink feed passageways which are discussed above in relation to FIG. 2.

Suitable embodiments can utilize capillary channels, which when viewed in cross-section approximate portions of simple geometrical shapes such as circles, ellipses, rectangles, and triangles, among other. Examples of which are provided above and below. In this particular embodiment, individual capillary channels 504 can approximate a portion of an ellipse. Other suitable embodiments can comprise irregularly shaped capillary channels.

Exemplary slots can have various suitable configurations. For example, some exemplary slots are scalable to any lengths achievable with conventional slots. In one example, an exemplary slot can have a length of at least about 23,000 microns. Exemplary slots can also have various suitable widths similar to those of conventional slots. In the embodiment represented in FIG. 6, slot 304*a* has an overall width $w_1$ of about 100 microns with central portion 502 represented by $w_2$ occupying about 60 microns and individual capillary channels adding about 20 microns each.

Figure 7:
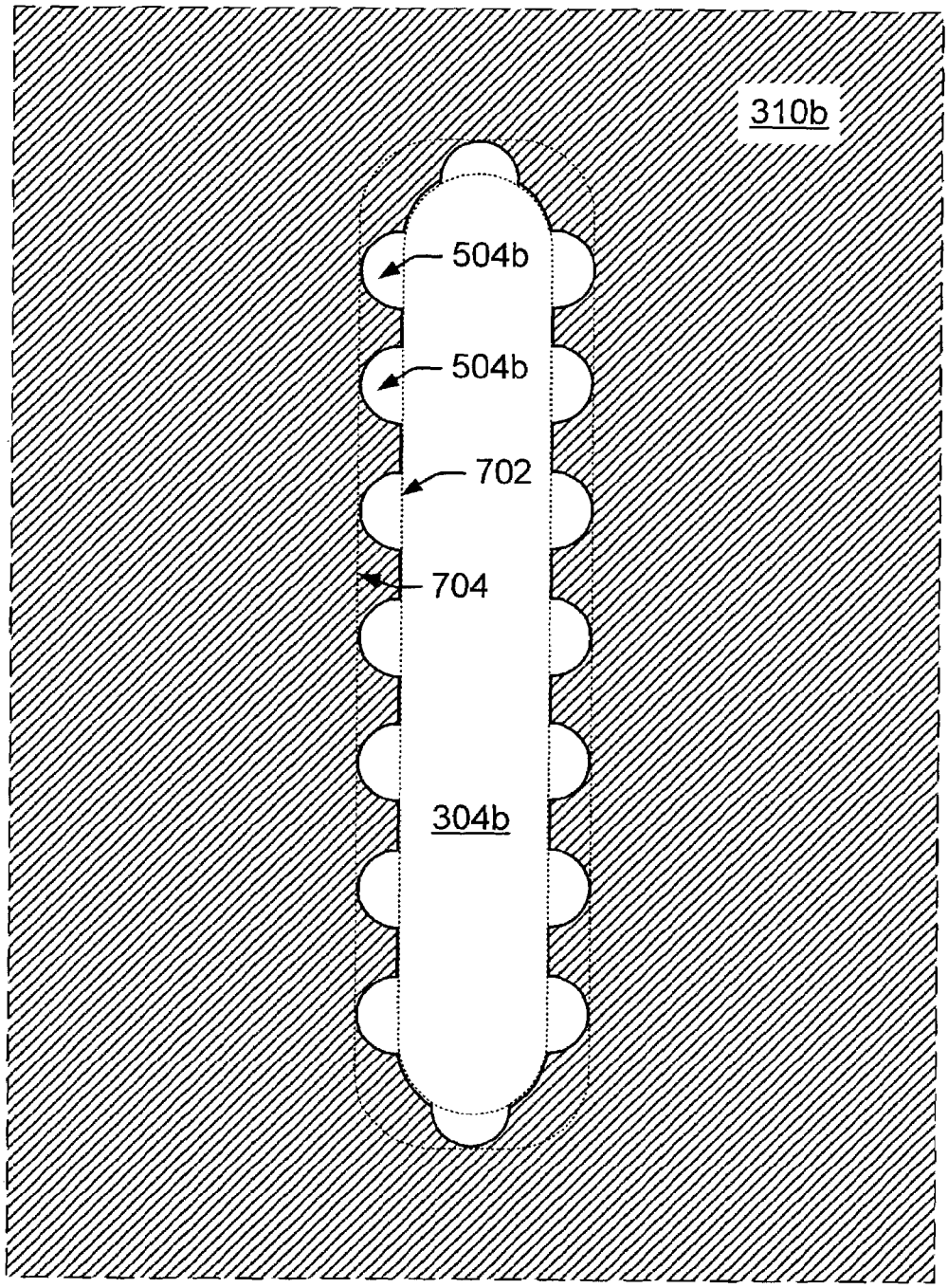
FIG. 7 shows a top view of an exemplary substrate in accordance with one embodiment.

FIG. 7 shows a cross-sectional view of another exemplary slot 304*b* that defines an inner perimeter 702 and an outer perimeter 704. Multiple regions, which in this embodiment comprise individual capillary channels 504*b*, extend between the inner and outer perimeters 702, 704. The cross-sectional view shown here is taken in a portion of the substrate which lies at least about 20 microns from both the first and second surfaces. Other cross-sectional views can be taken in other areas of the substrate.

Figure 7A:
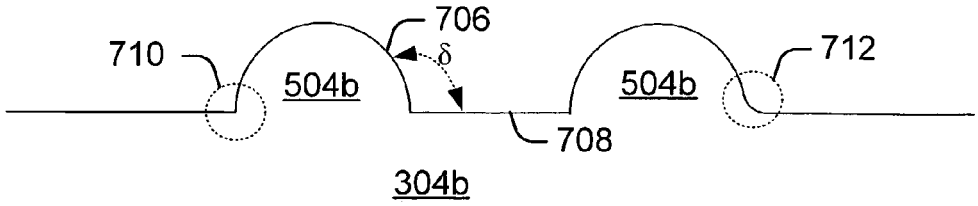
FIGS. 7*a*, 8–9 show top views of a portion of an exemplary slot in accordance with one embodiment.
Figure 8:
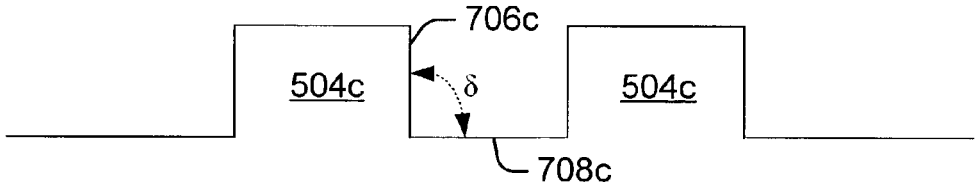

FIG. 7*a* shows an enlarged view of a portion of slot 304*b*. In this embodiment, individual capillary channels 504*b* approximate a portion of a circle. Slot 304*b* can be defined, at least in part, by a first sidewall 706 which defines an individual capillary channel 504*b*. In this embodiment, first sidewall 706 is arcuate; examples of other suitable configurations are described below. Slot 304*b* can also be defined, at least in part, by a second sidewall 708, which in this embodiment is generally planar. In some embodiments, first and second sidewalls 706, 708 are oriented through the substrate at less than 180 degrees relative to one another. In the embodiment shown in FIG. 7*a*, the angular relationship $\delta$ is about 100 degrees at the position indicated. FIG. 8 below illustrates an embodiment where the angular relationship $\delta$ is about 90 degrees.

In some embodiments, individual capillary channels intersect the central portion at a relatively pointed intersection region of substrate material, an example of which is designated at 710 in FIG. 7*a*. Other exemplary configurations can meet at a more rounded intersection region, an example of which is designated at 712 in FIG. 7*a*. Such a configuration may in some embodiments, reduce crack initiation areas in the slotted substrate.

Figure 9:
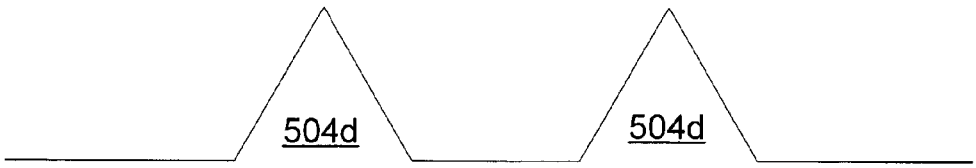

FIG. 8 shows another slot configuration where individual capillary channels 504*c* approximate a portion of a rectangle, while FIG. 9 shows further slot configuration where individual capillary channels 504*d* approximate a portion of a triangle. In the embodiment shown in FIG. 8, each of the first and second sidewalls 706*c* and 708*c* are planar. In an alternative embodiment, the first sidewall can be planar and the second sidewall can be arcuate. For example, a rectangular capillary channel positioned along an elliptical central portion can have such a configuration.

For the purposes of illustration, the described embodiments have individual capillary channels having generally uniform configurations along their length between the first and second surfaces of the substrate. Other suitable embodiments may have other configurations. For example, a capillary channel that approximates a portion of a circle may have a radius of 20 microns at the substrate's second surface and taper to a radius of 10 microns at the first surface.

In a further example, capillary channels may be utilized which pass through less than the entire thickness of the substrate. In one such example, if testing shows the potential for bubbles to accumulate in a given portion of a slot, such as a portion proximate to the first surface of the substrate, capillary channels could be utilized which extend from the first surface through less than an entirety of the substrate's thickness.

Exemplary slots can be formed utilizing any suitable technique or combination of techniques. For example, in one implementation, the slots are formed utilizing laser machining. Various suitable laser machines will be recognized by one of skill in the art. For example, one suitable laser machine that is commercially available is the Xise 200 laser Machining Tool, manufactured by Xsil ltd. of Dublin, Ireland.

In one suitable formation technique a laser beam scans a pattern which includes both a central portion and multiple capillary channels. In another embodiment, the laser beam first forms a central portion through the substrate and then forms associated capillary channels. Still other embodiments, may form the capillary channels first and then the central portion.

Other suitable techniques for forming the slots can be utilized. Such techniques include etching among others. One such procedure involves patterning a masking layer in a desired pattern followed by alternating acts of etching and passivating.

Other suitable slot formation techniques can utilize multiple removal techniques. For example, a first process, such as etching, can be utilized to form a central portion and then laser machining can be utilized to form the associated capillary channels. Still other embodiments may use a first removal technique such as sand drilling to "rough out" a central portion, followed by another process such as laser machining to finish the slot. The skilled artisan will recognize other satisfactory formation techniques.

Several embodiments have been described in the context of printing devices. The skilled artisan will recognize many of the embodiments to be equally suitable for other applications such as various MEMs devices.

CONCLUSION

The described embodiments can provide methods and systems for forming a slot in a substrate. The slots can supply ink to the various fluid ejecting elements connected to the slot. The slots can have one or more capillary channels positioned along a central portion. Such a configuration can maintain fluid flow in the slot in the presence of gas bubbles or other obstructive materials.

Although the inventive concepts have been described in language specific to structural features and methodological steps, it is to be understood that the appended claims are not necessarily limited to the specific features or steps described. Rather, the specific features and steps are disclosed as forms of implementation.

What is claimed is:

1. A semiconductor substrate comprising:

the substrate having a thickness defined by a first surface and a generally opposing second surface; and, a fluid-feed slot extending between the first surface and the second surface along a long axis which lies between the first and second surfaces, the fluid-feed slot being defined, at least in part, by a central portion and one or more capillary channels in fluid flowing relation to the central portion;

where individual capillary channels pass through the entire thickness of the substrate.

2. The semiconductor substrate of claim 1, wherein the one or more capillary channels are spaced generally uniformly around the central portion.

3. The semiconductor substrate of claim 1, wherein the central portion is generally rectangular in a cross-sectional view of the substrate taken generally parallel to the first surface.

4. The semiconductor substrate of claim 1, wherein individual capillary channels approximate a portion of a rectangle in a cross-sectional view of the substrate taken generally parallel to the first surface.

5. The semiconductor substrate of claim 1, wherein individual capillary channels approximate a portion of a circle in a cross-sectional view of the substrate taken generally parallel to the first surface.

6. The semiconductor substrate of claim 1, wherein individual capillary channels approximate a portion of an ellipse in a cross-sectional view of the substrate taken generally parallel to the first surface.

7. The semiconductor substrate of claim 1, wherein individual capillary channels approximate a portion of a triangle in a cross-sectional view of the substrate taken generally parallel to the first surface.

8. The semiconductor substrate of claim 1, wherein individual capillary channels pass through a majority of the thickness of the substrate.

9. A print cartridge comprising, at least in part, the semiconductor substrate of claim 1.

10. A microelectromechanical device comprising, at least in part, the semiconductor substrate of claim 1.

11. A print head comprising:

a substrate having a thickness defined by a first surface and a generally opposing second surface;

a slot formed in the substrate and extending along a long axis which lies between the first and second surfaces, the slot being defined, at least in part, by a plurality of sidewalls extending between the first surface and the second surface, wherein a first sidewall of the plurality of sidewalls defines an angular relationship with an adjacent second sidewall of the plurality of sidewalls that is less than 180 degrees through the substrate positioned between the first sidewall and the second sidewall;

where the first sidewall is planar and the second sidewall is planar;

at least one thin-film layer positioned over the first surface; and a barrier layer formed over the at least one thin-film and defining a plurality of fluid feed passageways positioned in fluid flowing relation with the slot.

12. The print head of claim 11, wherein the first sidewall defines an angular relationship with the second sidewall that is about 90 degrees.

13. The print head of claim 11, wherein the first sidewall is planar.

14. The print head of claim 11, wherein the first sidewall is arcuate.

15. The print head of claim 11, wherein the first sidewall is planar and the second sidewall is arcuate.

16. The print head of claim 11, wherein the first sidewall approximates a portion of a simple geometric shape.

17. The print head of claim 11 embodied in a print cartridge.

18. A semiconductor substrate comprising:

a slot formed between a first surface of a substrate and a generally opposing second surface of the substrate such that the substrate extends along a long axis which lies between the first and second surfaces, the slot being defined by an inner perimeter and an outer perimeter when viewed in a cross-section of the slot taken generally parallel to the first surface, wherein multiple regions of the slot approximating portions of simple geometric shapes extend between the inner perimeter and the outer perimeter.

19. The semiconductor substrate of claim 18, wherein the cross-section is taken at least 20 microns from the first surface and at least 20 microns from the second surface.

20. The semiconductor substrate of claim 18, wherein at least one of the multiple regions approximate a portion of an ellipse.

21. The semiconductor substrate of claim 18, wherein the multiple regions comprise more than four regions.

22. A print head substrate comprising:

the substrate having a thickness defined by a first surface and a second generally opposing second surface;

a slot formed in the substrate and extending between the first surface and the second surface along a long axis which does not intercept either of the first and second surfaces and being defined by a plurality of sidewalls, the slot defining an inner perimeter and having more than four of the plurality of sidewalls extending away from the inner perimeter;

at least one thin film layer formed over the first surface and configured to form a plurality of fluid-drop generators; and, a barrier layer formed over the at least one thin film layer and defining a plurality of fluid feed passageways in fluid receiving relation with the slot and configured to deliver fluid proximate individual fluid-drop generators.

23. The print head substrate of claim 22, wherein the more than four of the plurality of sidewalls extending away from the inner perimeter comprises more than eight of the plurality of sidewalls extending away from the inner perimeter.

24. The print head substrate of claim 22, wherein the more than four of the plurality of sidewalls extending away from the inner perimeter are arcuate.

25. The print head substrate of claim 22, wherein the more than four of the plurality of sidewalls extending away from the inner perimeter are planar.

26. The print head substrate of claim 22, wherein the more than four of the plurality of sidewalls extending away from the inner perimeter define, at least in part, simple geometric shapes.

27. The print head substrate of claim 22, wherein the more than four of the plurality of sidewalls extending away from the inner perimeter extend through the entire thickness defined by the first sidewall and the second sidewall.

28. A print head substrate comprising:

the substrate having a thickness defined by opposing first and second surfaces; and, a slot extending between the first surface and the second surface and extending along a long axis which passes through the substrate without intersecting either of the first and second surfaces, wherein the slot has a cross-section taken substantially parallel to the first surface that has alternating narrower and wider widths taken transverse the long axis.

29. The print head substrate of claim 28, the cross-section is taken at least 50 microns from the first surface and the second surface.

* * * * *